US006193112B1

(12) United States Patent
Santagiuliana

(10) Patent No.: US 6,193,112 B1
(45) Date of Patent: Feb. 27, 2001

(54) DOSING PUMP FOR THE SUPPLY OF LIQUID OR THICK SUBSTANCES FROM CONTAINERS

(75) Inventor: Evans Santagiuliana, Vicenza (IT)

(73) Assignee: Taplast Spa (IT)

( * ) Notice: Subject to any disclaimer, the term of this patent is extended or adjusted under 35 U.S.C. 154(b) by 0 days.

(21) Appl. No.: 09/367,607

(22) PCT Filed: Feb. 24, 1998

(86) PCT No.: PCT/EP98/01045

§ 371 Date: Aug. 18, 1999

§ 102(e) Date: Aug. 18, 1999

(87) PCT Pub. No.: WO98/37978

PCT Pub. Date: Sep. 3, 1998

(30) Foreign Application Priority Data

Feb. 28, 1997 (IT) ..... VI97A0035

(51) Int. Cl.[7] ..... B67D 5/42
(52) U.S. Cl. ..... 222/153.13; 222/321.9
(58) Field of Search ..... 222/153.13, 321.1, 222/321.7, 321.9

(56) References Cited

U.S. PATENT DOCUMENTS

| | | | | |
|---|---|---|---|---|
| 4,162,746 | | 7/1979 | Anderson et al. | 222/153.13 |
| 4,340,158 | * | 7/1982 | Ford et al. | 222/153.13 |
| 4,496,082 | * | 1/1985 | Corsette | 222/153.13 |
| 4,991,746 | | 2/1991 | Schultz | 222/153.13 |
| 5,405,057 | | 4/1995 | Moore | 222/153.13 X |
| 5,615,806 | * | 4/1997 | Grothoff | 222/153.13 |
| 5,899,363 | * | 5/1999 | Bliss, III et al. | 222/153.13 X |

FOREIGN PATENT DOCUMENTS

| | | |
|---|---|---|
| 94 18 511 | 3/1995 | (DE) . |
| 2 530 586 | 1/1984 | (FR) . |

* cited by examiner

*Primary Examiner*—Kenneth Bomberg
(74) *Attorney, Agent, or Firm*—Dykema Gossett, PLLC

(57) ABSTRACT

A dosing pump for supplying liquid or thick substances from containers. The dosing pump has a cylindrical chamber in communication with the container for receiving the liquid. The pump also has a cylindrical collar connecting the dosing pump with the container. The dosing pump also has sealing valves, a liquid dispenser and a hollow piston capable of sliding in the cylindrical chamber. The sliding piston has a tubular chamber with opposed radial guides to permit the piston to slide in the guide element. The dosing pump also has a recovery element for relocating the piston to a rest position after delivery of the liquid or thick substance is supplied. The piston has a guiding element sealed in the inner cylindrical chamber surrounding the piston having an inner cylindrical surface and longitudinal opposed radial grooves for receiving the guides therein. And the dosing pump has a striker plane having a shoulder that prevents rotation of the piston. The inner cylindrical surface is connected with the outer cylindrical surface of the supporting and guiding element by radial reinforcement wings.

5 Claims, 3 Drawing Sheets

DOSING PUMP FOR THE SUPPLY OF LIQUID OR THICK SUBSTANCES FROM CONTAINERS

The invention concerns a perfecting dosing pump particularly suitable for the delivery of liquid or thick substances from containers.

As it is known, for the dosing and the delivery of liquid or creamy substances such as soaps, cosmetic creams, cleansings or similars, dosing pumps, which are applied to the container that contains said substances, are fully used.

Said pumps are normally supplied with recovery means of the pumping piston to a rest position after any delivery and other pumps which contemplate devices for the blocking of said piston in a rest position are also known.

However the blocking means till now known present some limitations in such particular situations which can usually happen.

For example some blocking means of the pumping piston which are substantially formed of a striker, present in the guide of the piston, on which elements belonging to the piston contrast, after its partial rotation on its axis, are known.

This kind of solution reveals in the practice its limitations when in particular the pumping piston, usually surmounted by a dispenser, is subjected to a considerable pressure or torsion; it happens that the blocking system can subside and that the guide of the piston can break as a result causing or the lowering of the piston itself, or in any case the leakage of the liquid from the container. In any case the integrity of the product is loosen.

This event can usually happen, when for example, in case of packaging of containers supplied with this dosing pump for the large scale retail trade, it happens that they are stocked one over the other in even a considerable number; as a result it is obvious that the weight of the upper containers will exert a considerable pressure on those at the bottom of the pile. It's clear that these ones, by such a considerable weight, will be inevitably damaged, even being supplied with the blocking means before described.

Equally such event can occasionally happen even for a common consumer of said products, which can bring one of them with him for example during a journey: the container can always been subjected to pressures or torsions similar to those before described in case of stacking of suitcases, jolts, bumps etc.

The U.S. Pat. No. 4,162,746 discloses a liquid dispenser having a relatively rotable closure the main features of which are according to the precharacterizing portion of claim 1 of the instant invention, but do not completely overcome the possible breaking under special conditions.

The present invention intends to overcome such inconveniences.

The purpose of the invention is in particular for realizing a dosing pump for the delivery of liquid or creamy substances from containers, in which the pumping piston resists to a greater vertical load in a rest position.

A further purpose of the invention is for, in any case, the blocking of said piston resists, in a rest position, to different stresses, such as torsions, bumps etc. ensuring more the integrity of the product.

The mentioned purposes are achieved by the realization of a dosing pump for liquids to apply to a container that according to the main claim comprises:

- a cylindrical chamber communicating with said container and suitable for receiving said liquid to deliver;
- a cylindrical collar suitable for connecting said pump to the container of the liquid;

sealing valves;

- a hollow piston axially sliding in said cylindrical chamber, supplied inside with a tubular chamber and outside with longitudinal opposed guides, in order to permit the sliding along a supporting and guiding element, said piston ending with an element dispenser of liquid;

recovery means for recovering this piston to a rest position after delivery;

- a supporting and guiding element for said piston presenting, in the inner cylindrical surface, longitudinal grooves which cooperate with said guides of said piston;
- at least a striker plane of the longitudinal guides of said piston which develops itself beginning from at least one of said grooves, along an arch of said inner cylindrical surface of said supporting element, suitable for keeping said piston in a rest position, by contact of one end of one of said longitudinal guides on said striker plane, when the piston is rotated on its axis, said striker plane presenting a shoulder of such a length that it prevents any further rotation of said piston along said striker plane, said dosing pump being wherein said inner cylindrical surface is laterally connected with the outer cylindrical surface of said supporting and guiding element by a plurality of radial reinforcement wings.

Advantageously the presence of the shoulder and of the radial reinforcement wings permits to the pumping piston to withstand pressures, torsions or even considerable stresses without breaking the supporting and guiding element.

The mentioned purposes and advantages will be better pointed out during the description of a preferred embodiment, given as an example but not as a restriction and represented in the enclosed drawings where:

Figure 1:
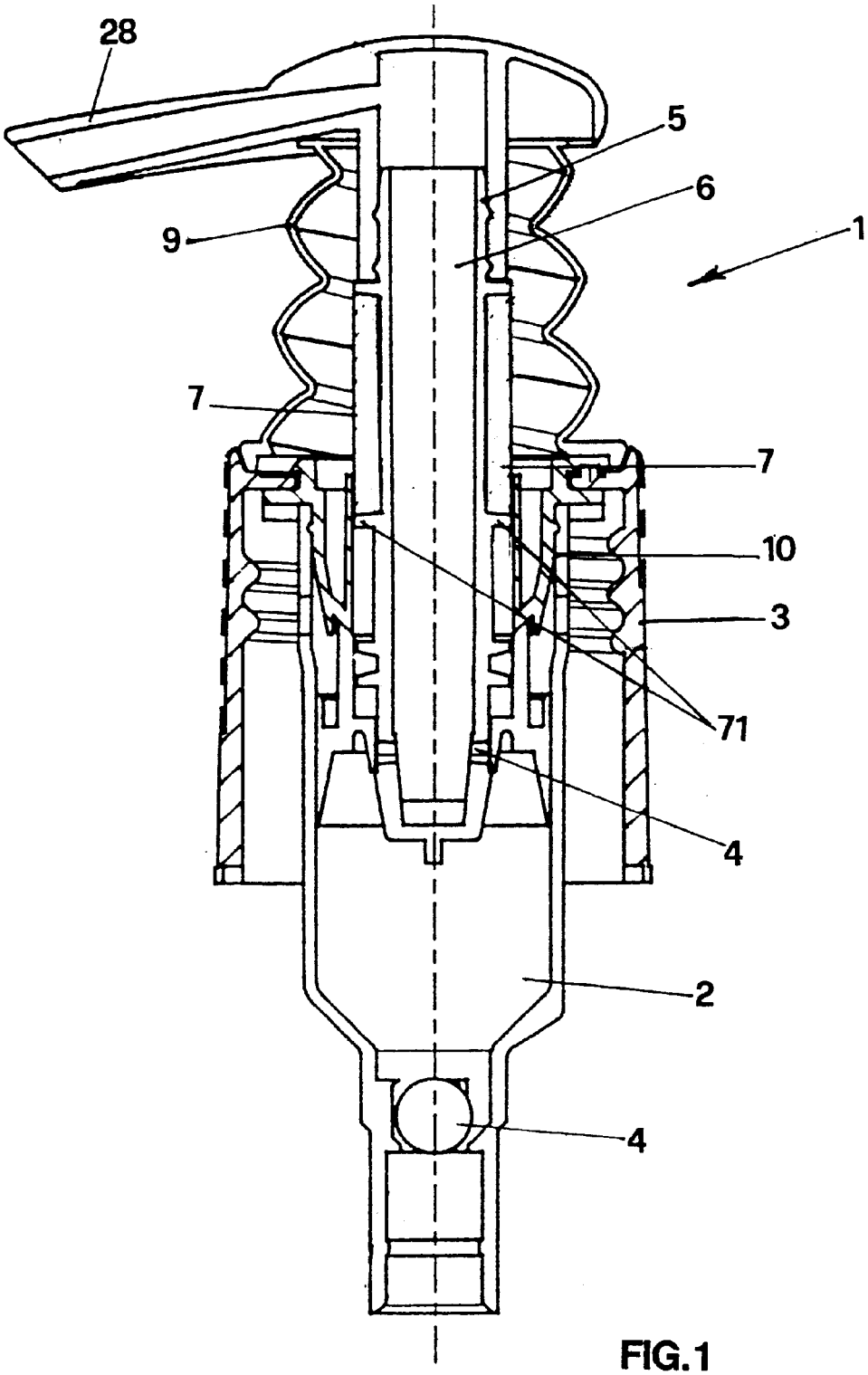
FIG. 1 represents the dosing pump of the invention in a longitudinal section.

The pump of the invention is represented in FIG. 1, where it is indicated as a whole with 1, and it can be observed that it comprises a cylindrical chamber 2, communicating with the container of the liquid and suitable for receiving it for the delivery. The presence of a cylindrical collar 31 suitable for connecting said pump with the container and of sealing valves 4, can also be observed. Also a piston 5, axially sliding in said cylindrical chamber, supplied inside with a tubular chamber 6, communicating on one side with the cylindrical chamber 2 and on the other with the delivering element 28, is present. Opposite longitudinal guides 7 are present outside the piston. Said guides permit the sliding along a supporting and guiding element indicated as a whole with 10 and represented with more details in FIGS. from 2 to 5. The recovery element 9, formed, in the example, of a bellows for recovering this piston to a rest position after delivery, is finally present.

Figure 3:
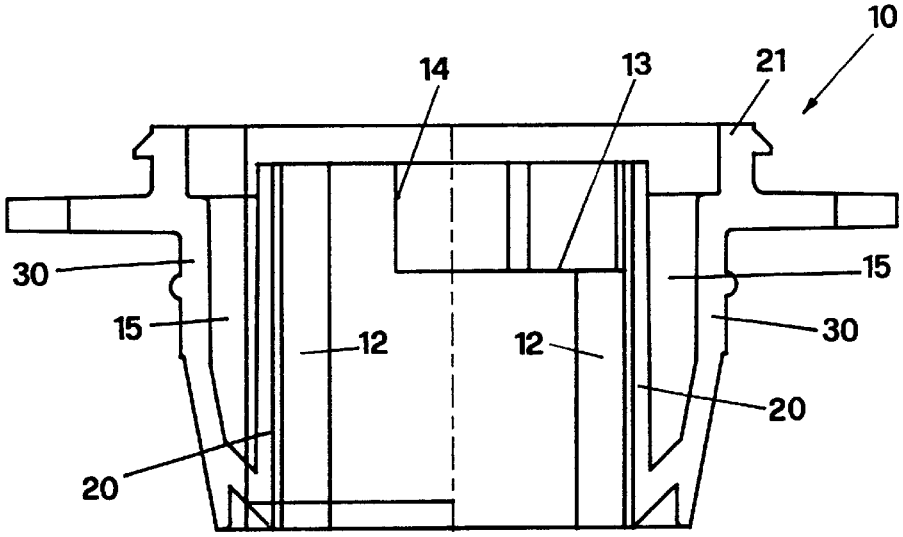
FIG. 3 shows the supporting and guiding element of the piston of the pump in a longitudinal section according to the line III—III of the FIG. 2.
Figure 2:
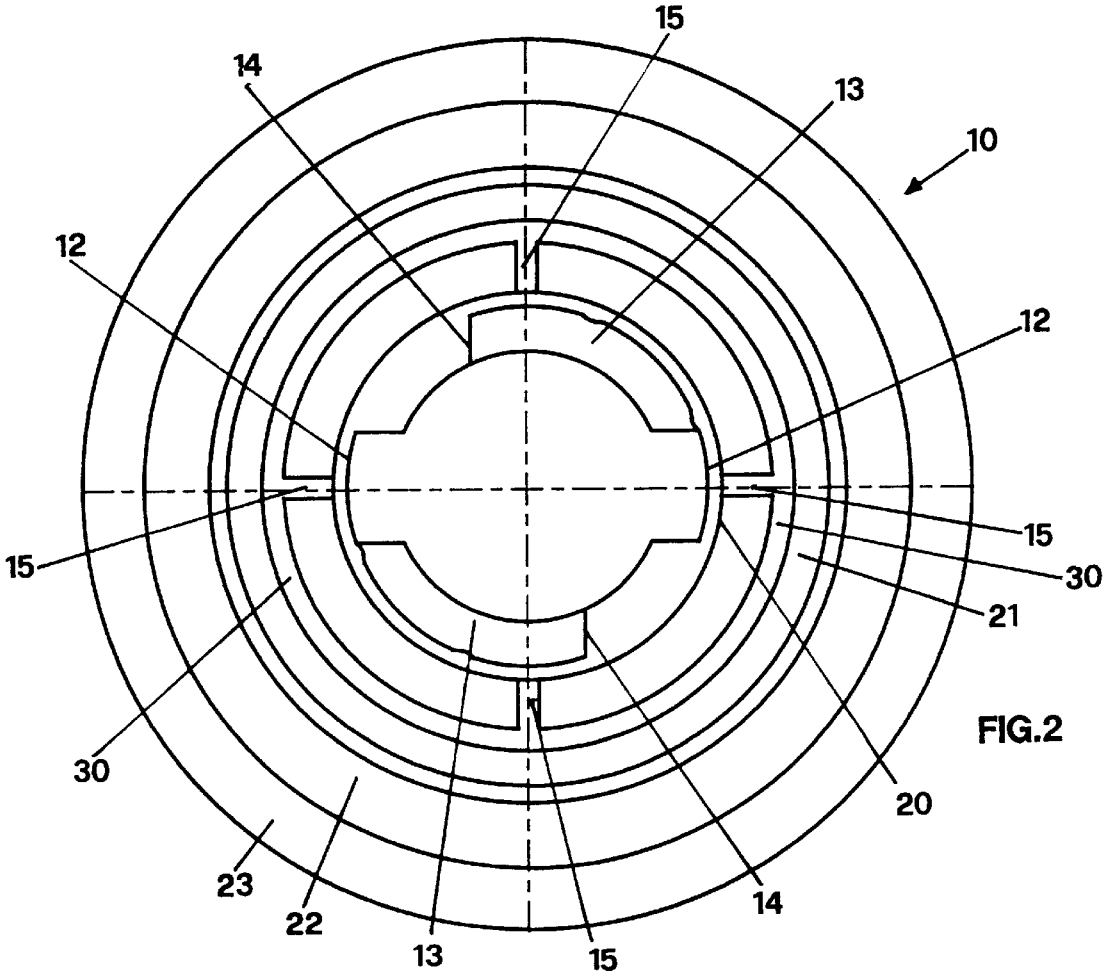
FIG. 2 shows the supporting and guiding element in a top view.

In FIGS. 2 and 3, it can be observed that said supporting and guiding element 10 of the piston presents two longitudinal grooves 12 which cooperate with the guides of said piston. It can also be observed that said element 10 presents striker planes 13, which develop themselves beginning from said grooves perpendicularly to them and along an arch of the inner cylindrical surface 20 of said element 10. Said striker planes are suitable for keeping the piston 5 in a rest position, if an operator rotates said piston in such a way that the lower ends 71 of the guides 7, belonging to it, are opposite to said striker plane 13. Besides, the striker planes 13 end with a shoulder 14 of such a length to prevent any further rotation of the piston along the striker plane. According to this preferred embodiment of the invention the length of this shoulder is at least the 30% of the length of one of the longitudinal guides 7 of said piston 5: by this it's sure that there will be no further rotation of the piston or breaking of the supporting element 10.

Radial reinforcement wings 15, arranged along planes orthogonal among them, which laterally connect the inner cylindrical surface 20 of the element 10 with the outer cylindrical surface 30 of the same element 10, are also present. The presence of these radial reinforcement wings is very important in order to prevent the breaking of the supporting and guiding element 10, in case in which the piston 5, kept in a rest position by the striker plane 13 and the shoulder 14, is subjected to pressures, torsions or even considerable pressures.

In this preferred embodiment it can be finally observed that in FIGS. 2 and 3 the element 10 can be further radially developed in another wall 21 and in two parts, having the shape of ah annulus, 22 and 23, well pointed out in FIG. 3.

It can also be specified that in this preferred embodiment the element 10 is realized by moulding, together with the cylindrical collar with whom it is connected with the plug of the container of the liquid.

Figure 4:
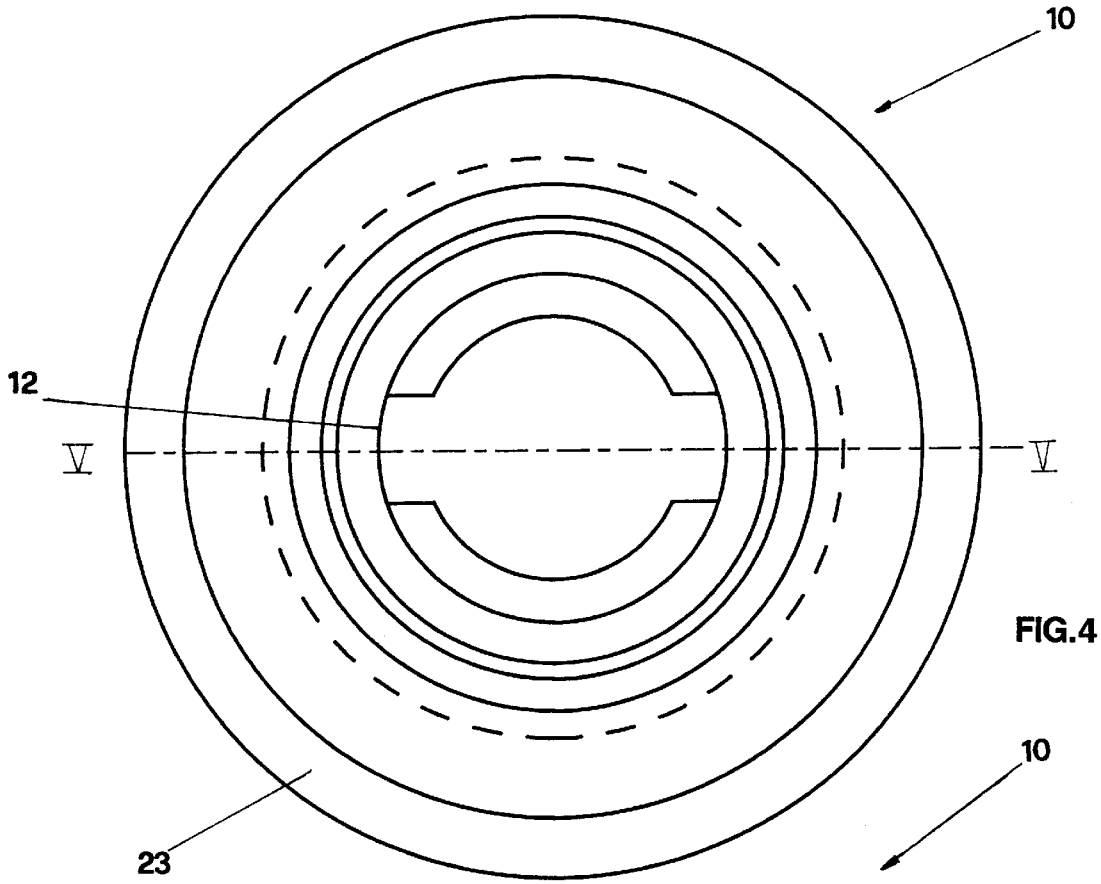
FIG. 4 shows the supporting element in a bottom view.
Figure 5:
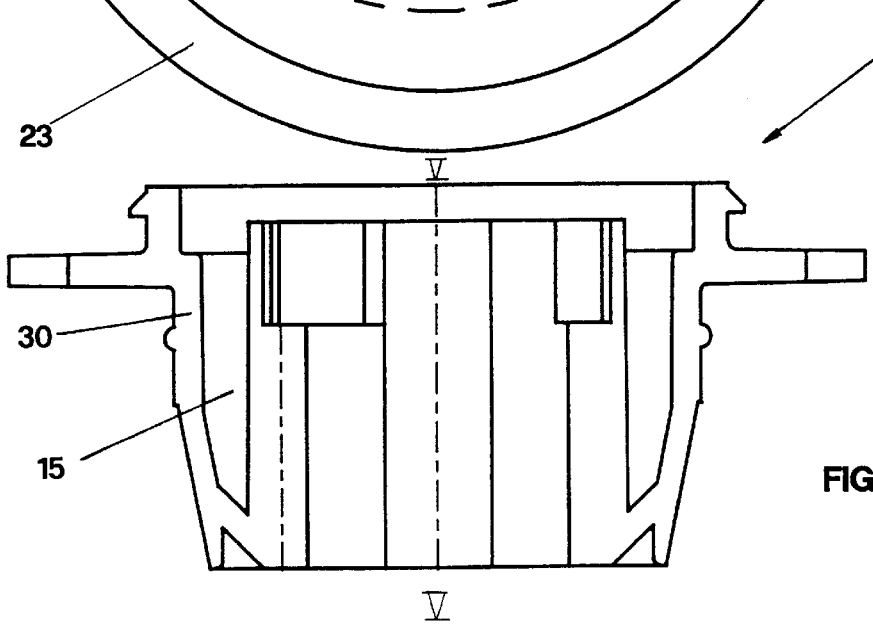
FIG. 5 is the section according to the line V—V of the supporting element of the FIG. 4.

The element 10 is also represented in FIGS. 4 and 5 respectively in a bottom view and in an orthogonal section along a plane orthogonal to the direction V—V pointed out in FIG. 4.

What is claimed is:

1. A dosing pump for the delivery of liquid or creamy substances from containers comprising:

a cylindrical chamber for communicating with said container and for receiving said substances therefrom;

a cylindrical collar for connecting said pump to the container;

a piston having an axis and being axially slidable within said cylindrical chamber, said piston having an outer wall, a hollow tubular interior chamber and longitudinal, radially opposite guides extending from said outer wall, said guides having lower ends;

a supporting and guiding element located within the chamber for slidably receiving the piston therein;

recovery means for recovering said piston to a rest position after delivery;

the supporting and guiding element having an inner cylindrical surface, an outer cylindrical surface and radial wings reinforceably connecting said inner and outer cylindrical surfaces, and longitudinal grooves which cooperate with said guides of said piston;

a striker plane extending from at least one of said grooves, along an arch of said inner cylindrical surface, for keeping said piston in the rest position by contact of the lower end of at least one of said longitudinal guides against said striker plane when the piston is rotated on its axis; a shoulder at an end of the striker plane remote from the longitudinal grooves having a length sufficient to prevent further rotation of said piston along said striker plane.

2. The dosing pump according to claim 1, wherein said radial reinforcement wings are disposed in planes orthogonal to one another.

3. The dosing pump according to claim 1, wherein the longitudinal guides have a length and said shoulder has a length of at least 30% of the length of said longitudinal guides.

4. The dosing pump according to claim 1, wherein said supporting and guiding element is formed by moulding the cylindrical collar with the plug of the container of the liquid.

5. The dosing pump according to claim 1, wherein the supporting and guiding element includes an annular wall at an upper end for engaging the container and the collar.

* * * * *